US006811407B2

(12) United States Patent
Watanabe

(10) Patent No.: US 6,811,407 B2
(45) Date of Patent: Nov. 2, 2004

(54) SOCKET FOR ELECTRICAL PARTS

(75) Inventor: Tsuyoshi Watanabe, Kawaguchi (JP)

(73) Assignee: Enplas Corporation, Saitama (JP)

( * ) Notice: Subject to any disclaimer, the term of this patent is extended or adjusted under 35 U.S.C. 154(b) by 0 days.

(21) Appl. No.: 10/158,014

(22) Filed: May 31, 2002

(65) Prior Publication Data

US 2002/0182915 A1 Dec. 5, 2002

(30) Foreign Application Priority Data

May 31, 2001 (JP) ..... 2001-164294

(51) Int. Cl.[7] ..... H01R 12/00
(52) U.S. Cl. ..... 439/66; 439/331
(58) Field of Search ..... 439/266, 66, 71, 439/331

(56) References Cited

U.S. PATENT DOCUMENTS 5,061,192 A * 10/1991 Chapin et al. ..... 439/66
5,259,781 A * 11/1993 Baumberger et al. ..... 439/362

* cited by examiner

*Primary Examiner*—Khiem Nguyen
(74) *Attorney, Agent, or Firm*—Staas & Halsey LLP

(57) ABSTRACT

A socket for an electrical part has a socket body to which a number of contact pins are arranged, and each of the contact pins has one end portion which electrically contacts a terminal of an electrical part, another one end portion which electrically contacts a printed circuit board, and an elastic portion between the one and another end portions of the contact pin so as to be flexed in one direction. The one end portion of the contact pin is positioned so as to project outward through one through hole formed to the socket body and bent and inclined in the same direction as the flexed direction of the elastic portion of the contact pin with respect to a perpendicular direction.

10 Claims, 10 Drawing Sheets

PRIOR ART

SOCKET FOR ELECTRICAL PARTS

BACKGROUND OF THE INVENTION

1. Field of the Invention

The present invention relates to a socket for electrical parts for detachably accommodating and holding an electrical part such as a semiconductor device (called as "IC package" hereinlater), and more particularly, relates to a socket for electrical parts having improved contact pins to be contacted to or separated from terminals of the electrical part.

2. Related Art of the Invention

In a known art, an IC socket of the type mentioned above is preliminarily disposed on a printed circuit board and an IC package is then mounted to and accommodated in this IC socket to thereby establish an electrical connection between the IC package and the printed circuit board.

In such prior art as mentioned above, however, the IC packages includes an LGA (Land Grid Array) type of a structure in which a number of plate-shaped electrodes as terminals are disposed to a lower surface of a rectangular plate-shaped package body.

In this type of the IC package, under the accommodated state of the IC package in the IC socket, when a number of plate-shaped electrodes are contacted to contact portions formed to upper end portions of contact pins of the IC socket, the electrical connection between the respective plate-shaped electrodes of the IC package and the printed circuit board are established through the respective contact pins.

Such prior art structure will be explained hereunder with reference to FIGS. 12A and 12B, for example. That is, the contact pin 1 is composed of an upper contact portion 1*a*, a lower contact portion 1*b* and an intermediate elastic portion 1*c* as viewed in FIG. 12A or 12B. The upper contact portion contacts the plate shaped electrode of the IC package 2 when the contact pin 1 contacts the IC package 2, the lower contact portion 1*b* contacts the printed circuit board 3, and the elastic portion 1*c* has a circularly curved shape and the upper and lower contact portions 1*a* and 1*b* are connected through this elastic portion 1*c*.

The upper and lower contact portions 1*a* and 1*b* are inserted into through holes 4*a* and 4*b*, respectively, formed to a socket body 4 of an IC socket so that the inserted tip end portions are contacted to the IC package 2 and the printed circuit board 3, respectively, and pressed and then deformed.

However, in the conventional structure such as mentioned above with reference to FIGS. 12A and 12B, the contact pin 1 is elastically deformed. That is, the upper contact portion 1*a* abuts against the plate-shaped electrode 2*a* of the IC package 2 and the lower contact portion 1*b* abuts against the printed circuit board 3, and in this state, these contact portions 1*a* and 2*b* are pressed in directions of arrows in FIG. 12A. Accordingly, the central arcuate elastic portion 1*c* is deformed and flexed as shown by an arrow in FIG. 12B. In this operation, the upper and lower contact portions 1*a* and 1*b*, which are perpendicularly aligned, are obliged to be inclined and contacted to (interfere with) peripheral edge portions of the through holes 4*a* and 4*b* of the socket body 4. In such state, smooth vertical motion of the contact portions 1*a* and 1*b* will not be expected, thus being inconvenient.

SUMMARY OF THE INVENTION

An object of the present invention is to substantially eliminate defects or drawbacks encountered in the prior art mentioned above and to provide a socket for electrical parts capable of preventing the contact pin from interfering with the socket body at the time of deformation thereof to carry out smooth motion of the contact pin.

This and other objects can be achieved according to the present invention by providing, in one aspect, a socket for an electrical part having a socket body to which a number of contact pins are arranged, in which the each of the contact pins has one end portion which electrically contacts a terminal of an electrical part and another one end portion which electrically contacts a printed circuit board, wherein the contact pin has an elastic portion between the one and another end portions of the contact pin so as to be flexed in one direction and, before mounting of the socket body to the printed circuit board, the one end portion of the contact pin is positioned so as to project outward through one through hole formed to the socket body and bent and inclined in a same direction as the flexed direction with respect to a perpendicular direction.

In another aspect, there is provided a socket for an electrical part having a socket body to which a number of contact pins are arranged, in which the each of the contact pins has one end portion which electrically contacts a terminal of an electrical part and another one end portion which electrically contacts a printed circuit board, wherein the contact pin has an elastic portion between the one and another end portions of the contact pin so as to be flexed in one direction and, before accommodation of the electrical part in the socket body, the another one end portion of the contact pin is positioned so as to project outward through another one through hole formed to the socket body and bent and inclined in a same direction as the flexed direction with respect to a perpendicular direction.

In a further aspect, there is also provided a socket for an electrical part having a socket body to which a number of contact pins are arranged, in which the each of the contact pins has one end portion which electrically contacts a terminal of an electrical part and another one end portion which electrically contacts a printed circuit board, wherein the contact pin has an elastic portion between the one and another end portions of the contact pin so as to be flexed in one direction and, the one and another end portions of the contact pin are positioned so as to project outward through one and another through holes, respectively, formed to the socket body and bent and inclined in a same direction as the flexed direction with respect to a perpendicular direction.

In a further preferred aspect, there is provided a socket for an electrical part comprising:

a socket body having a base portion and an upper plate disposed above the base portion; the socket body being provided with a number of contact pins which contact terminals of the electrical part for electrical connection between the terminals and a printed circuit board;

an open/close member mounted to the base portion of the socket body to be pivotal with respect thereto; and a pressing member mounted to the open/close member for pressing the electrical part, each of the contact pins having one end portion which electrically contacts the terminal of the electrical part, another one end portion which electrically contacts the printed circuit board and an elastic portion between the one and another end portions of the contact pin so as to be flexed in one direction, and the one and another end portions of the contact pin being positioned, so as to project outward through one through hole formed to the upper plate and through another one through hole formed to the base portion, respectively, and bent and inclined in a same direction as the flexed direction with respect to a perpendicular direction.

In the above respective aspect, the elastic portion may have an arcuate shape, angled bent shape or substantially S-shape flexed in a direction with respect to the perpendicular direction.

According to the structures of the present invention mentioned above, the contact pin is composed of the one (upper) end portion, the other (lower) end portion and the intermediate elastic portion which is flexed in one direction with respect to the perpendicular direction. The upper end portion of the contact pin projects upward through the upper through hole formed to the socket body (upper plate) to be bent and inclined in the same direction as the flexed direction of the elastic portion.

Therefore, when the upper end portion of the contact pin is pressed downward, the elastic portion is flexed and deformed downward, and at its position, the upper end portion is directed substantially perpendicularly, so that the interference of the upper end portion with the peripheral edge portion of the upper through hole can be prevented and smooth operation can be achieved to thereby ensure the electrical contact between the terminal of the electrical part and the contact pin.

On the other hand, in another aspect, the lower end portion of the contact pin projects downward through the lower through hole formed to the socket body (base portion) to be bent and inclined in the same direction as the flexed direction of the elastic portion.

Therefore, when the lower end portion of the contact pin is pressed upward, the elastic portion is flexed and deformed upward, and at its position, the lower end portion is directed substantially perpendicularly, so that the interference of the lower end portion with the peripheral edge portion of the lower through hole can be prevented and smooth operation can be achieved to thereby ensure the electrical contact between the terminal of the electrical part and the contact pin.

In the other aspects of the embodiment, the upper and lower end portions of the contact pin are both projects through the upper and lower through holes of the socket body, so that the interference of these upper and lower end portions of the contact pin with the peripheral edge portions of the upper and lower holes can be effectively prevented, thus performing the smooth operation and ensuring the electrical contact.

The nature and further characteristic features of the present invention will be made more clear from the following descriptions made with reference to the accompanying drawings.

BRIEF DESCRIPTION OF THE DRAWINGS

In the accompanying drawings:

FIGS. 12A and 12B are sectional views showing arrangement of a conventional contact pin, in which FIG. 12A shows a view before the mounting of the IC socket to the printed circuit board and FIG. 12B is a view after the mounting thereto and the accommodation of the IC package.

DESCRIPTION OF THE PREFERRED EMBODIMENTS

Figure 1:
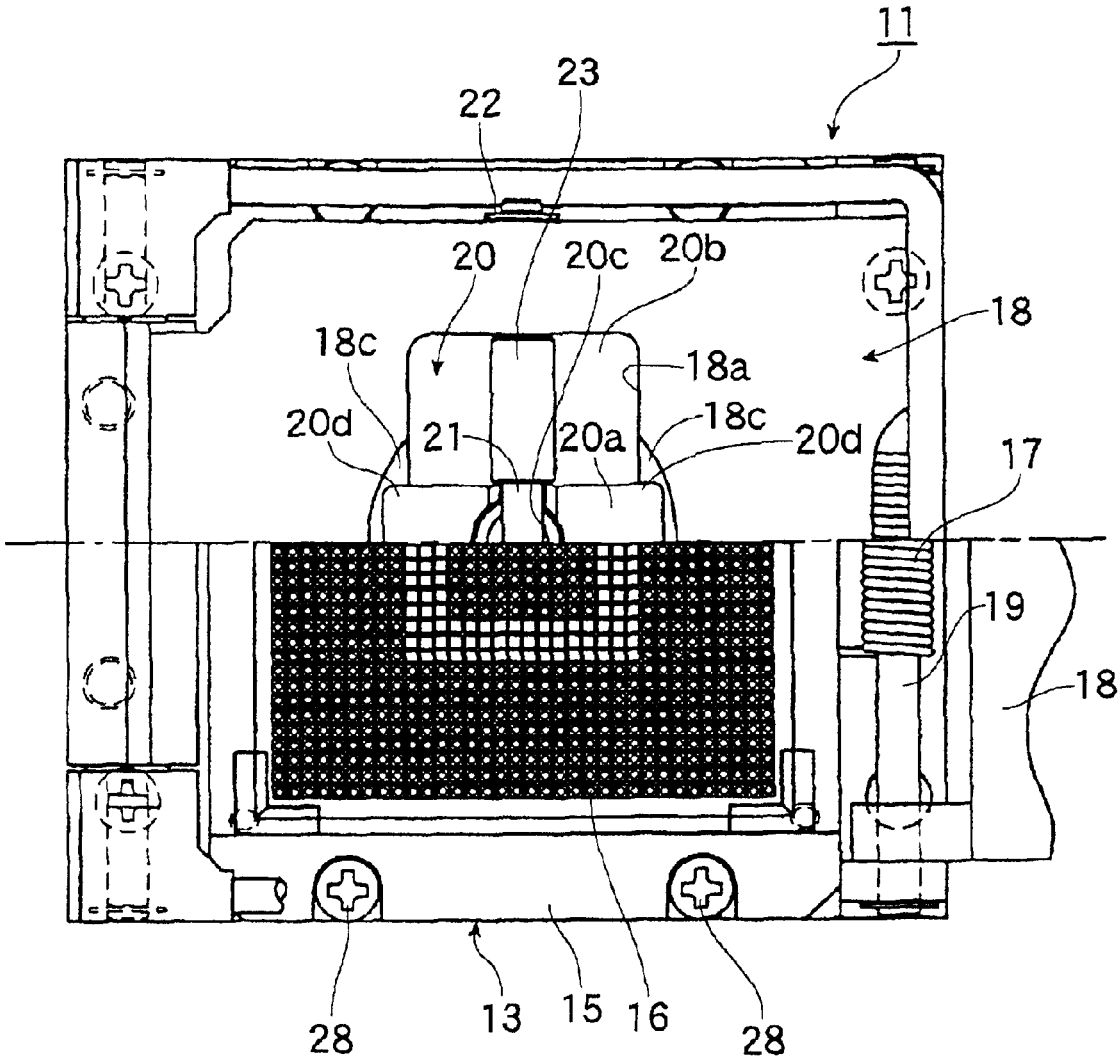
FIG. 1 is a plan view of an IC socket according to a first embodiment of the present invention, in which a lower half of an open/close member is opened.
Figure 2:
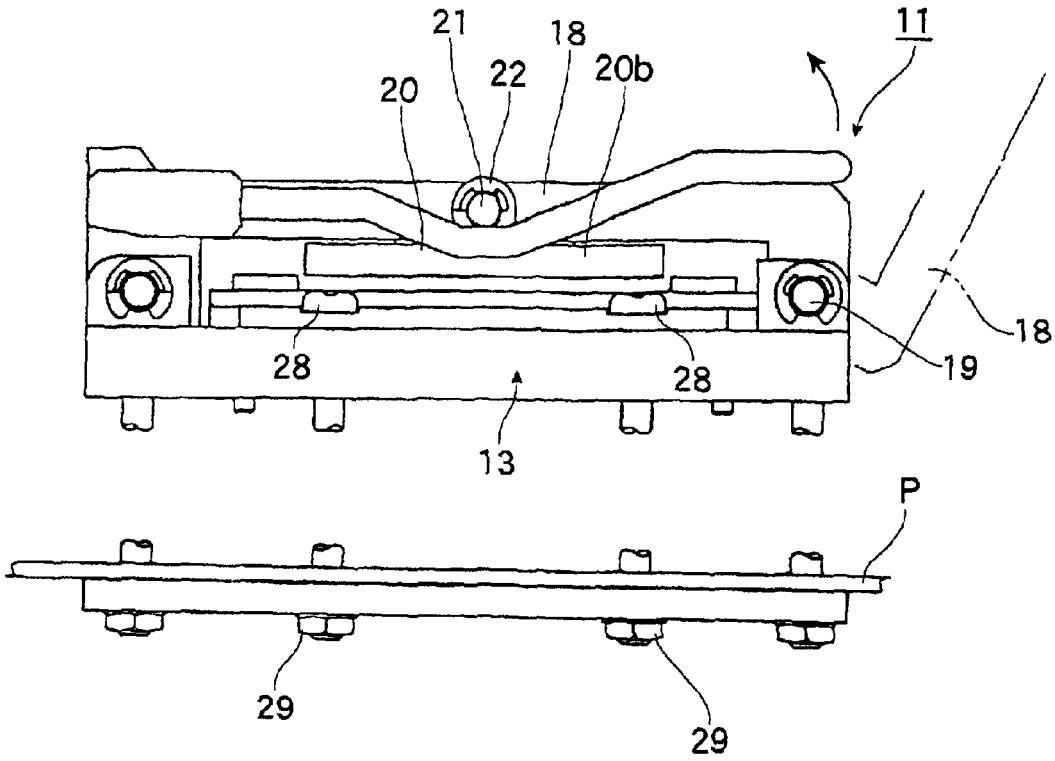
FIG. 2 is a front view of the IC socket of the embodiment of FIG. 1.
Figure 3:
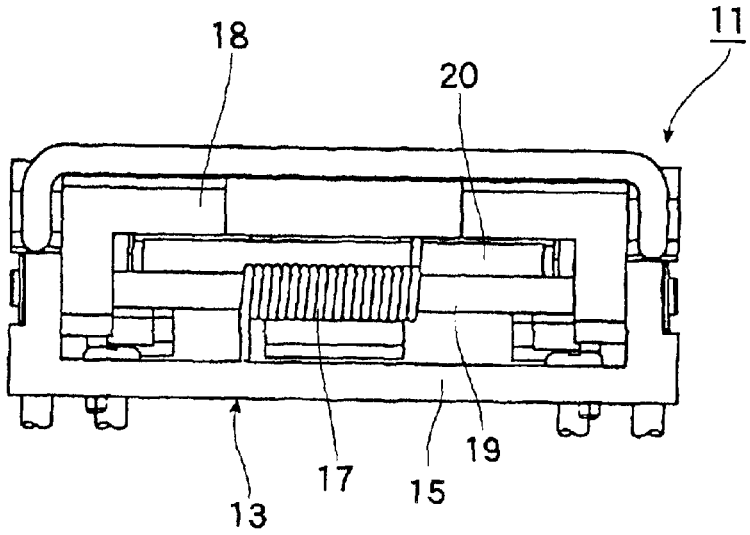
FIG. 3 is a right-hand side view of the IC socket of the embodiment of FIG. 1.

The preferred embodiments of the present invention will be described hereunder with reference to the accompanying drawings.

[First Embodiment]

A first embodiment of the present invention will be first described with reference to FIGS. 1 to 9, in which an IC socket as a socket for electrical parts is generally denoted by reference numeral 11.

The IC socket 11 is for a socket for establishing an electrical connection between a plate-shaped electrode 12*b* as a terminal of an IC package 12 and a printed circuit board P of an IC test device for carrying out a performance test of the IC package.

The IC package 12 has so-called an LGA (Land Grid Array) type structure, in which a number of plate-shaped electrodes 12*b* are arranged in matrix at a lower surface of an IC package body 12*a* having a rectangular frame structure.

Further, it is to be noted that terms "upper", "lower", "right", "left" and the like are used herein with reference to the illustration in the drawings or in an installed state.

Figure 4:
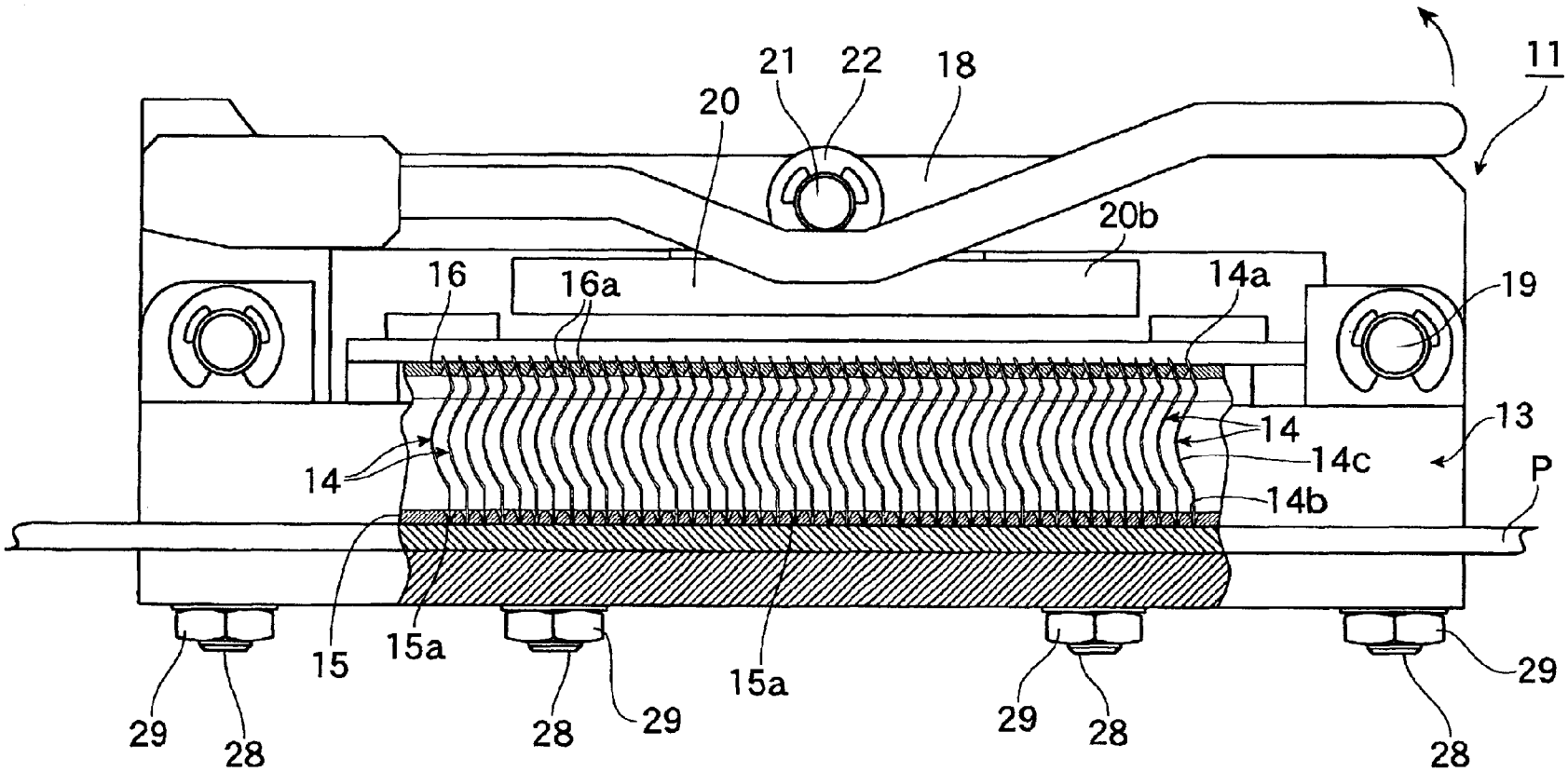
FIG. 4 is a front view of the IC socket of FIG. 1, in which a portion at which contact pins are arranged is broken to be opened.

The IC socket 11 has, as shown in FIG. 4, a socket body 13 which is mounted to a printed circuit board P such as burn-in-board, and the socket body 13 is provided with a number of contact pins 14 contacting the plate-shaped electrodes 12*b*, respectively. The socket body 13 is also provided with, as described hereinlater, a base portion 15 and an upper plate 16 disposed above the base portion 15 in the state illustrated in FIG. 4 or 7, for example.

Figure 7:
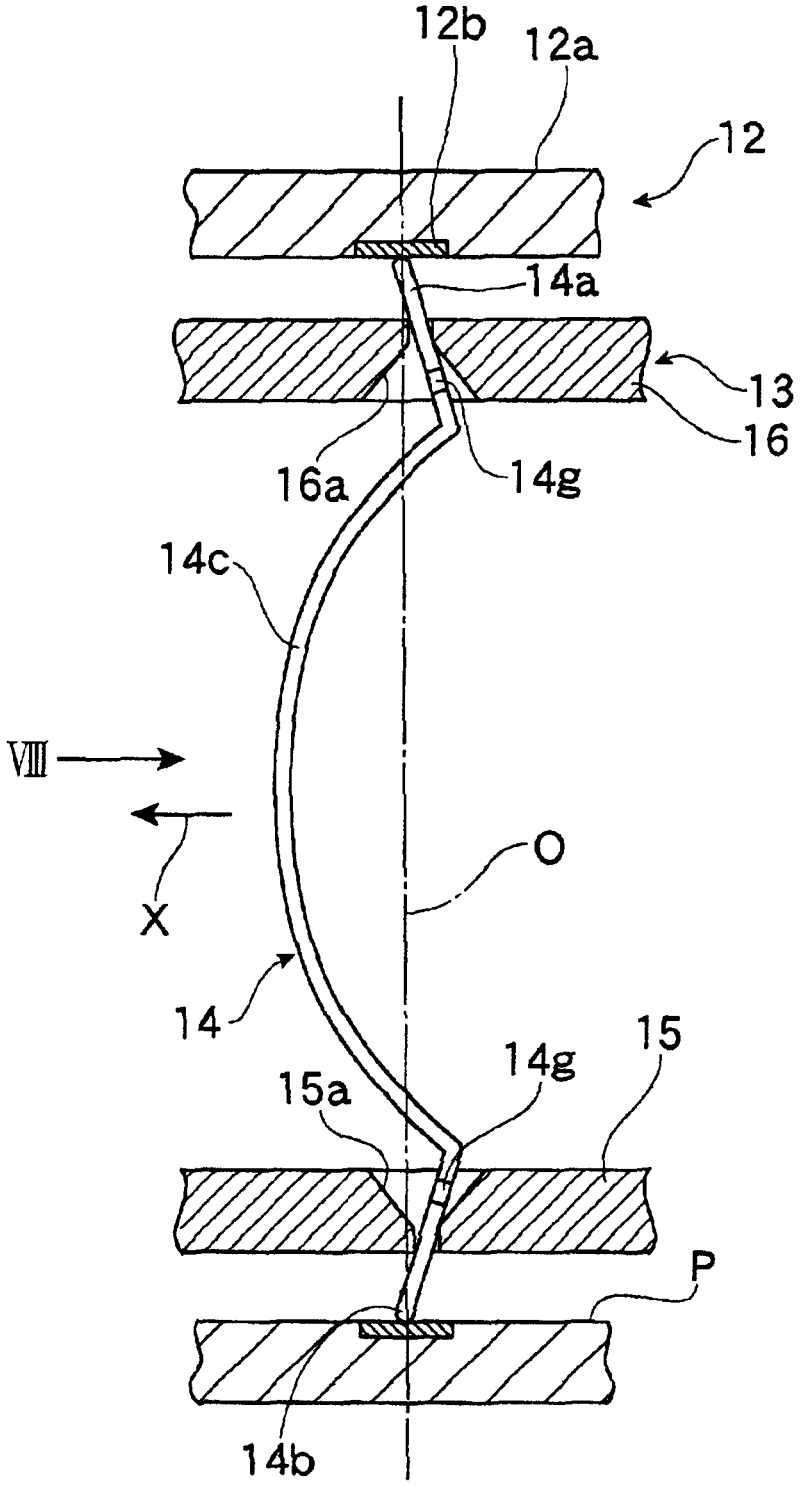
FIG. 7 is an enlarged sectional view of the arrangement of the contact pin of the IC socket of the first embodiment before the mounting to a printed circuit board.
Figure 8:
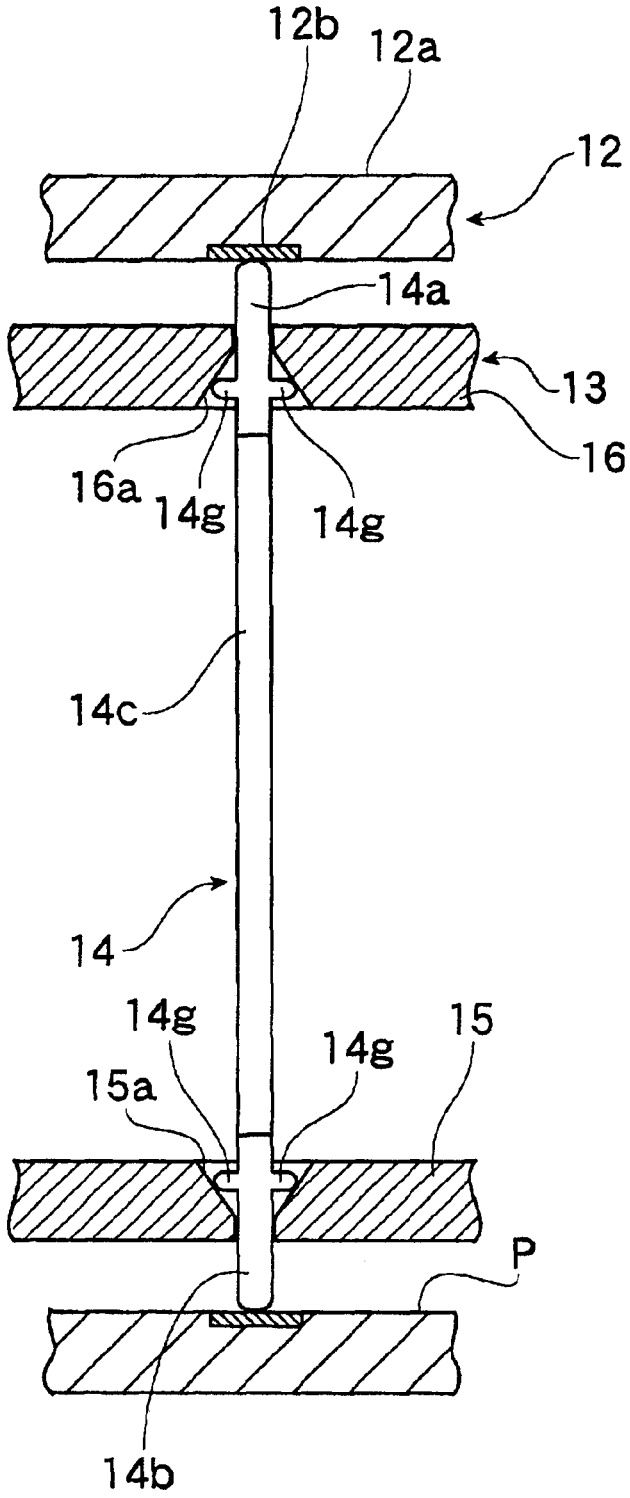
FIG. 8 is a sectional view viewed from a direction of an arrow VIII in FIG. 7.
Figure 9:
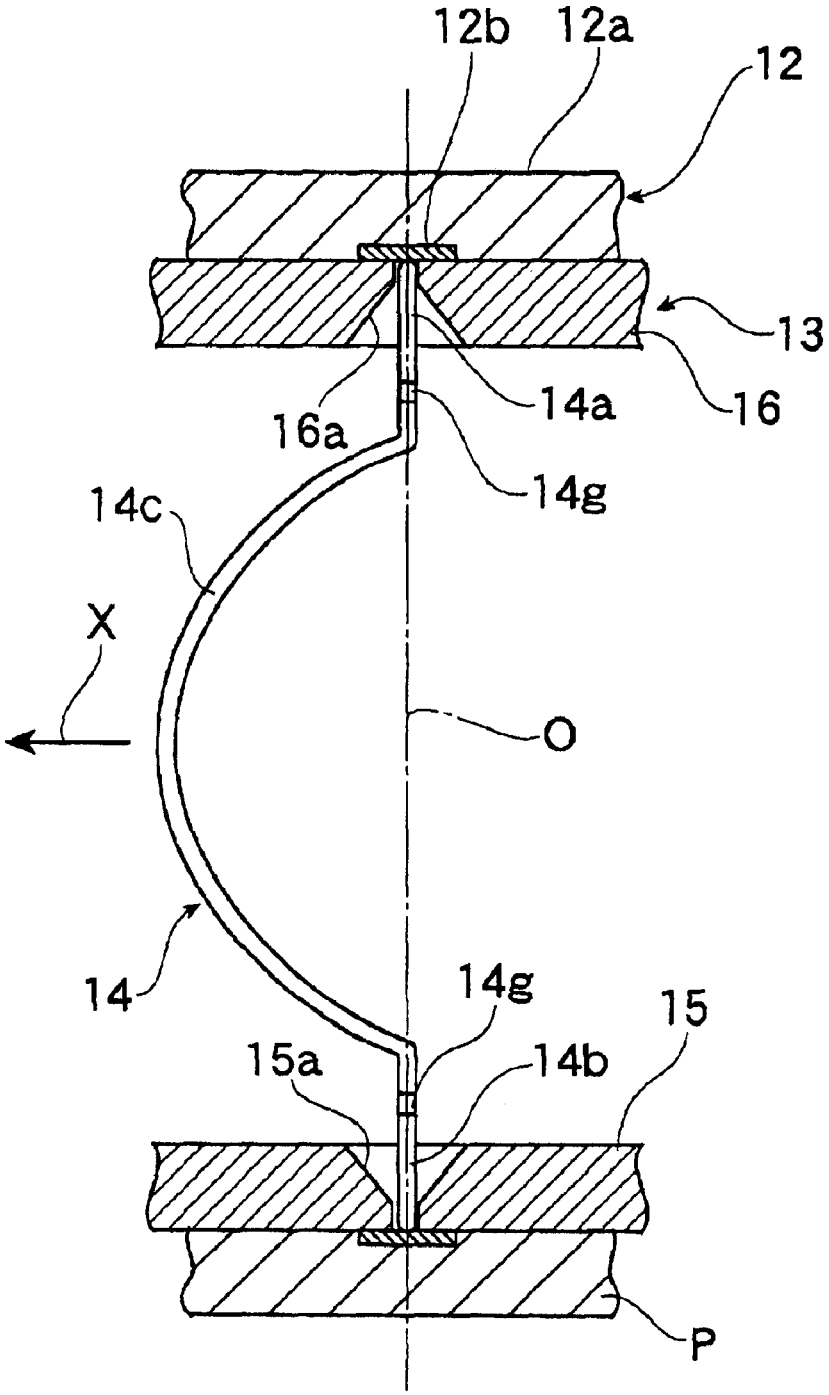
FIG. 9 is an enlarged sectional view of the arrangement of the contact pin of the IC socket according to the first embodiment, in which the IC socket is mounted to the printed circuit board and an IC package is accommodated.

The structure of each of the contact pins 14 is shown in FIGS. 7 and 8. With reference to FIGS. 7 and 8, the contact pin 14 is formed from a long plate-shaped conductive member through a press working so as to provide a bent structure having an upper end portion 14*a*, a lower end portion 14*b* and an intermediate elastic portion 14*c* formed between these upper and lower end portions 14*a* and 14*b* so as to provide a circular (arcuate) shape as shown so that when a pressing force is applied, this elastic portion 14*c* is flexed in one direction (direction of arrow X in FIG. 7).

With reference to FIG. 7 showing the arrangement of the contact pin 14 of the IC socket 11 before the mounting of the IC package 12, the upper end portion 14*a* of the contact pin 14 projects upward through an upper through hole 16*a* formed to the upper plate 16 of the socket body 13 and is bent and inclined in the same direction of the flexed direction of arrow X with respect to a perpendicular direction O.

Further, referring to FIG. 7, before the mounting of the socket body 13, i.e., contact pin 14, to the printed circuit board P, the lower end portion 14*b* of the contact pin 14 projects downward through the lower through hole 15*a* formed to the base portion 15 of the socket body 13 and is bent and inclined in the same direction of the flexed direction A with respect to a perpendicular direction O, i.e. a vertical direction of the socket body and the printed circuit board in a usual arrangement.

Furthermore, the upper and lower end portions 14*a* and 14*b* of the contact pin 14 are formed with flange portions 14*g*, 14*g*, respectively, which abut against the lower through hole 15*a* of the base portion 15 and the upper through hole 16*a* of the upper plate 16 of the socket body 13 to thereby hold the contact pin 14 between the base portion 15 and the upper plate 16 of the socket body 13.

The contact pin 14 is disposed between the upper plate 16 and the base portion 15 in the manner that the upper end portion 14*a* of the contact pin 14 is inserted into the upper though hole 16*a* formed to the upper plate of the socket body 13 and the lower end portion 14*b* of the contact pin 14 is inserted into the lower through hole 15*a* formed to the base portion 15 of the socket body 13.

An open/close member 18 is mounted to the base portion 15 of the socket body 13 to be pivotal through a shaft or pin 19 and urged upward by means of spring 17 in a direction to be opened. A pressing member 20 for pressing the IC package 12 is disposed for the open/close member 18, which has a central opening 18*a* to which a pair of support portions 20*a* of the pressing member 20 are fitted.

Figure 5:
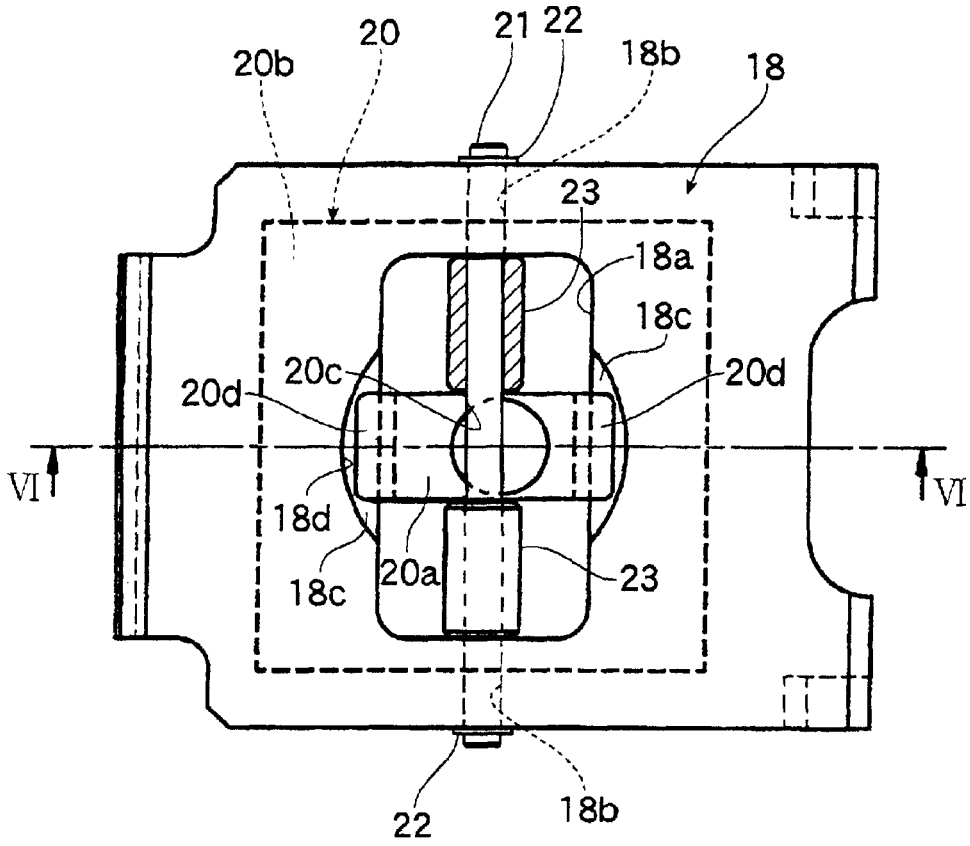
FIG. 5 is a plan view of the IC socket of FIG. 1 to show the open/close member and a press member thereof.
Figure 6:
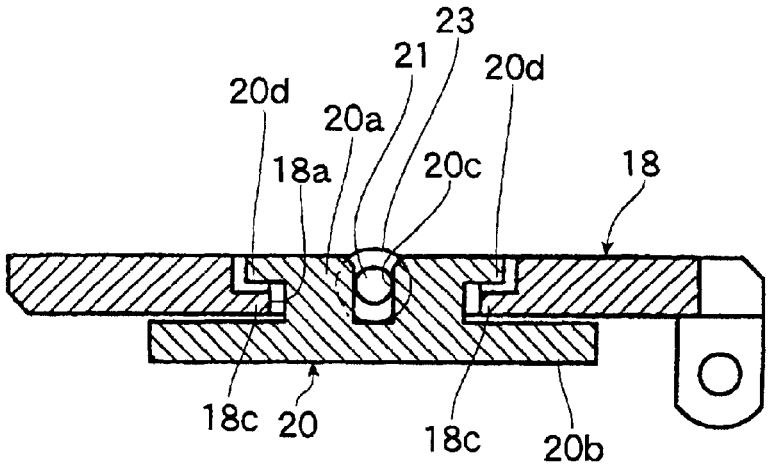
FIG. 6 is a sectional view taken along the line VI—VI of FIG. 5 according to the first embodiment.

As shown in FIGS. 4 to 6, the pressing member 20 is provided with a pressing plate 20*b* having a rectangular shape corresponding to a size of the IC package 12*b*, and a pair of support portions 20*a* project from substantially the central portion of the pressing plate 20*b*.

The support portions 20*a* are formed with engaging portions 20*d* so as to project sideways, as shown in FIG. 6, and these engaging portions 20*d* are engaged with engagement portions 18*c* (portions to be engaged) formed to the peripheral edge portion of the opening 18*a* of the open/close member 18, so that the open/close member 18 is supported and held by the pressing member 20.

Further, a slit 20*c* is formed between the paired support portions 20*a* so as to extend vertically in a closed state of the open/close member 18 (in a horizontally arranged state such as shown in FIG. 6), and the shaft 21 is inserted into this slit 20*c* so as to be inserted into an insertion hole 18*b* formed to the open/close member 18. E-rings 22 are mounted to be detachably to the shaft 21 at its both side portions to the open/close member 18, and by dismounting the E-rings 22, the shaft 21 can be pulled out.

Accordingly, the shaft 21 is inserted into the slit 20*c* of the support portions 20*a* and, in the closed state of the open/close member 18, the pressing member 20 is movable in the vertical direction. The shaft 21 is then inserted into a spacer 23, such as shown in FIG. 5, so as to press the pressing member 20 via the spacer 23.

The IC socket of the structure mentioned above will operates in accordance with the following descriptions.

In the state that the IC socket is not mounted to the printed circuit board, with reference to FIG. 7, the lower end portion 14*b* of the contact pin 14 projects downward through the lower through hole 15*a* formed to the base portion 15 of the socket body 13, and the lower end portion 14*b* is bent and inclined in the direction flexed with respect to the perpendicular line O.

On the other hand, as also shown in FIG. 7, the upper end portion 14*a* of the contact pin 14 projects upward through the upper through hole 16*a* formed to the upper plate 16 of the socket body 13, and the upper end portion 14*a* is bent and inclined in the direction flexed with respect to the perpendicular line O.

Under the state mentioned above, the IC socket 11 is fixed to the printed circuit board P by means of bolts 28 and nuts 29 as shown in FIG. 4, and in this state, the lower end portions 14*b* of the contact pins 14 are pressed upward. Thus, the elastic portion 14*c* between the upper and lower end portions 14*a* and 14*b* of the contact pin 14 is flexed in the direction of the arrow X, and accordingly, the lower end portion 14*b* is moved to take the position along the perpendicular direction O. Accordingly, since the lower end portion 14*b* of the contact pin 14 is not inclined, different from the conventional art, the interfering of the lower end portion 14*b* of the contact pin 14 with the peripheral edge portion of the lower through hole 15*a* can be effectively suppressed, and accordingly, the lowering of the contact pressure between the lower end portion 14*b* of the contact pin 14 and the printed circuit board P can be prevented and the desired contact pressure can be hence ensured.

On the other hand, under the state that the IC socket 11 is mounted on the printed circuit board P, the IC package 12 is accommodated in the IC socket 11 to carry out the performance test of the IC package 12. In this case, the IC package 12 is mounted on the upper plate 16, the open/close member 18 is closed and the IC package 12 is then pressed by the pressing member 20 from the upper side.

According to such operation, the plate-shaped electrode 12*b* of the IC package 12 contacts the upper end portion 14*a* of the contact pin 14 to be thereby depressed downward. Then, the elastic portion 14*c* of the contact pin 14 is flexed in the direction of the arrow X in FIG. 9, and the upper end portion 14*a* of the contact pin 14 has a position along the perpendicular direction O. Accordingly, since the upper end portion 14*a* of the contact pin 14 is not inclined, different from the conventional art, the interfering of the upper end portion 14*a* of the contact pin 14 with the peripheral edge portion of the upper through hole 16*a* can be effectively suppressed, and accordingly, the lowering of the contact pressure between the upper end portion 14*a* of the contact pin 14 and the plate-shaped electrode 12*b* of the IC package 12 can be prevented and the desired contact pressure can be hence ensured.

[Second Embodiment]

Figure 10:
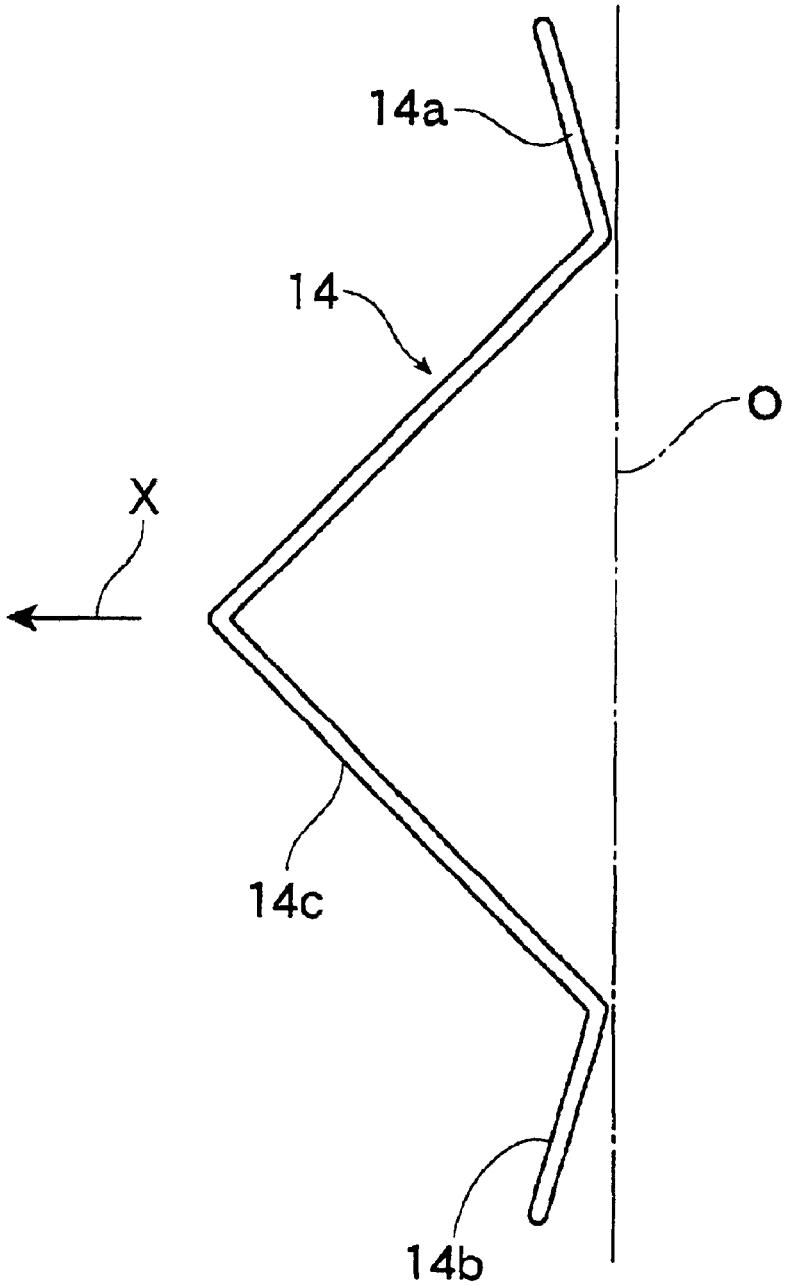
FIG. 10 is a front view of a contact pin of an IC socket according to a second embodiment of the present invention.

FIG. 10 represents the second embodiment of the present invention.

The contact pin 14 of this second embodiment differs from that of the first embodiment in the shape of the elastic portion 14*c*. That is, the elastic portion 14*c* in the first embodiment provides substantially a circularly curved shape, whereas the elastic portion 14*c* in this embodiment provides an angled bent shape approximately showing " <" shape.

In this embodiment of the contact pin 14 having the "<"-shaped elastic portion 14*c*, this elastic portion 14*c* is flexed in the direction of the arrow X in FIG. 10, and the upper and lower end portions 14*a* and 14*b* of the contact pin 14 are also bent in the X-arrow direction with respect to the perpendicular direction O, so that the upper and lower end portions 14*a* and 14*b* are positioned along the perpendicular direction, as in the first embodiment, in the state that the IC socket 11 is fixed to the printed circuit board P with the IC package 12 being accommodated therein.

The structure and functions other than that mentioned above are substantially the same as those of he first embodiment, and accordingly, the details thereof are herein omitted.

[Third Embodiment]

Figure 11:
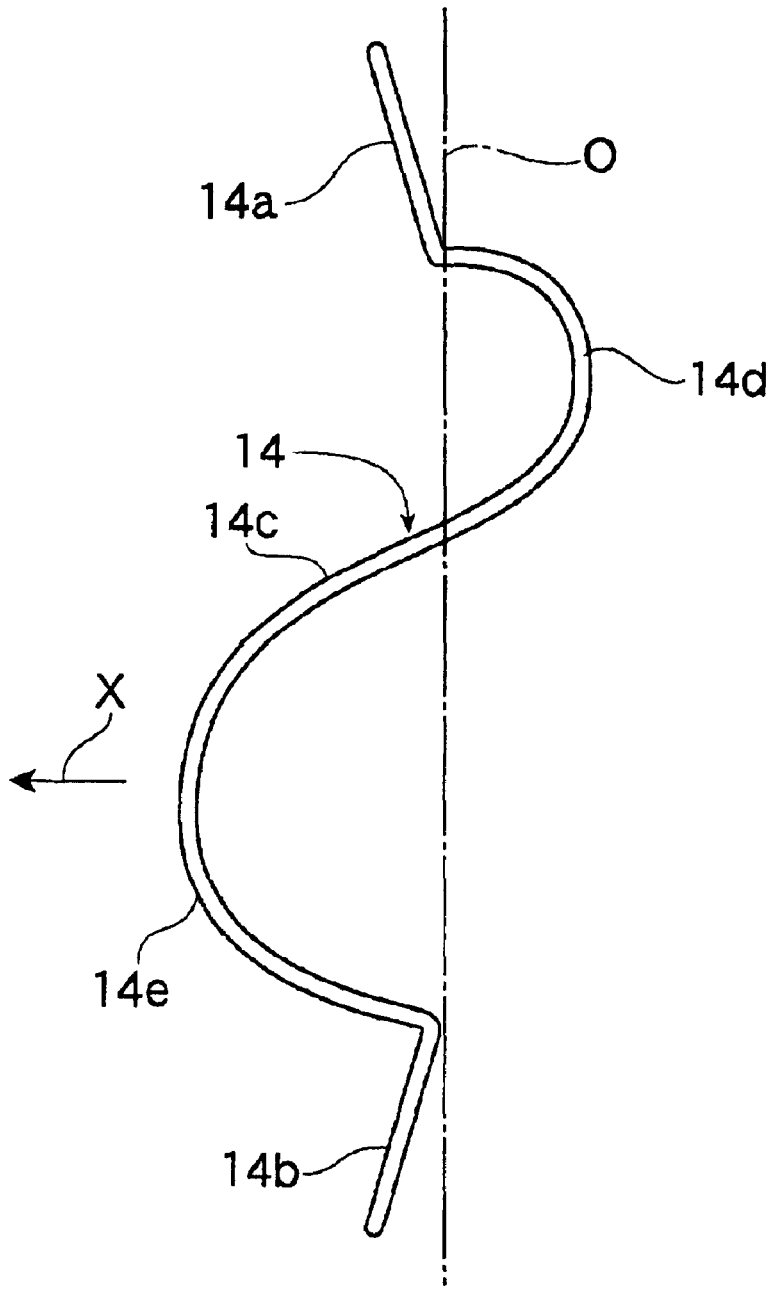
FIG. 11 is a front view of a contact pin of an IC socket according to a third embodiment of the present invention.
Figure 12A:
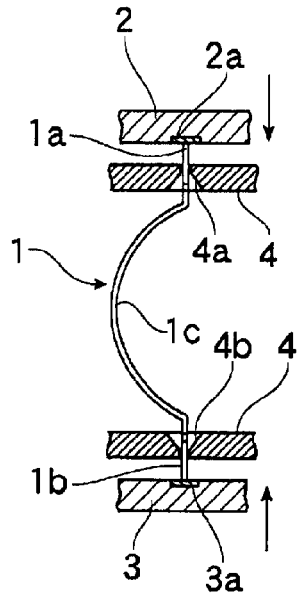
Figure 12B:
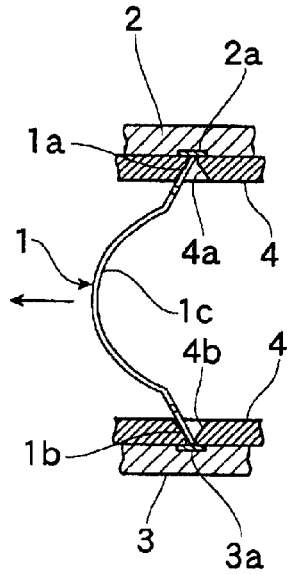
PRIOR ART FIG.12B

FIG. 11 represents the third embodiment of the present invention.

The contact pin 14 of this third embodiment differs from that of the first embodiment in the shape of the elastic portion 14*c*. That is, the elastic portion 14*c* in the first embodiment provides substantially a circularly curved shape, whereas the elastic portion 14*c* in this embodiment provides an approximately S-shape having upper and lower curved portions 14*d* and 14*e* so that the lower curved portion 14*e* has a curvature of radius larger than that of the upper curved portion 14*d* and that the elastic portion 14*c* is deformable in the X-arrow direction as a whole. The upper and lower end portions 14*a* and 14*b* of this contact pin 14 are bent and inclined in the same direction as the flexed direction thereof with respect to the perpendicular direction O.

According to this third embodiment, substantially the same function and effect as those in the first embodiment can be achieved.

The structure and functions other than that mentioned above are substantially the same as those of the first embodiment, and accordingly, the details thereof are herein omitted.

Further, it is to be noted that the present invention is not limited to the described embodiment and many other changes and modifications may be made without departing from the scope of the appended claims.

For example, although, in the described embodiments, both the upper and lower end portions of the contact pin are bent, a contact pin having either one of the upper and lower end portions is bent may be adopted.

What is claimed is:

1. A socket for an electrical part having a socket body to which a number of contact pins are arranged, in which each of the contact pins has a first end portion which electrically contacts a terminal of the electrical part and a second end portion which electrically contacts a printed circuit board, wherein each of the contact pins has an elastic portion between the first and second end portions so as to be flexed in one direction and, before mounting of the socket body to the printed circuit board, the first end portion is positioned projecting upward through one through hole formed to the socket body and is bent and inclined in the same direction as the flexed direction with respect to a perpendicular direction, and an upper edge of the first end portion is offset in a horizontal direction with respect to a center line of the one through hole, and after the mounting of the socket body to the printed circuit board and accommodating of the electrical part to the socket, the upper edge of the first end portion is positioned at approximately the same height as the height of an upper end of the one through hole formed to the socket body and the first end portion is oriented in a perpendicular direction along the one through hole.

2. A socket for an electrical part according to claim 1, wherein said elastic portion has an arcuate shape.

3. A socket for an electrical part according to claim 1, wherein said elastic portion has an angled bent shape.

4. A socket for an electrical part according to claim 1, wherein said elastic portion has a substantially S-shape.

5. A socket for an electrical part having a socket body to which a number of contact pins are arranged, in which each of the contact pins has a first end portion which electrically contacts a terminal of the electrical part and a second end portion which electrically contacts a printed circuit board, wherein each of the contact pins has an elastic portion between the first and second end portions so as to be flexed in one direction and, before accommodation of the electrical part in the socket body, the second end portion is positioned projecting downward through one through hole formed to the socket body and is bent and inclined in the same direction as the flexed direction with respect to a perpendicular direction, and a lower edge of the second end portion is offset in a horizontal direction with respect to a center line of the one through hole, and after mounting of the socket body to the printed circuit board and accommodating of the electrical part to the socket, the lower edge of the second end portion is positioned at approximately the same height as the height of a lower end of the one through hole formed to the socket body and the second end portion is oriented in a perpendicular direction along the one through hole.

6. A socket for an electrical part according to claim 5, wherein said elastic portion has an arcuate shape.

7. A socket for an electrical part according to claim 5, wherein said elastic portion has an angled bent shape.

8. A socket for an electrical part according to claim 5, wherein said elastic portion has a substantially S-shape.

9. A socket for an electrical part having a socket body to which a number of contact pins are arranged, in which each of the contact pins has a first end portion which electrically contacts a terminal of the electrical part and a second end portion which electrically contacts a printed circuit board, wherein each of the contact pins has an elastic portion between the first and second end portions so as to be flexed in one direction and, before mounting of the socket body to the printed circuit board, the first and second end portions are positioned projecting upward and downward, respectively, through first and second through holes formed to the socket body and are bent and inclined in a same direction as the flexed direction with respect to a perpendicular direction, and an upper edge and a lower edge, respectively, of the first and second end portions are offset in a horizontal direction with respect to a center line of the first and second through holes, and after the mounting of the socket body to the printed circuit board and accommodating of the electrical part to the socket, the upper edge of the first end portion is positioned at approximately the same height as the height of an upper end of the first through hole, and the lower edge of the second end portion is positioned at approximately the same height as the height of a lower end of the second through hole, and the first and second end portions, respectively, are oriented in a perpendicular direction along the first and second through holes.

10. A socket for an electrical part comprising:

a socket body having a base portion and an upper plate disposed above the base portion, said socket body being provided with a number of contact pins which contact terminals of the electrical part for electrical connection between the terminals and a printed circuit board;

an open/close member mounted to the base portion of the socket body to be pivotal with respect thereto; and a pressing member mounted to the open/close member for pressing the electrical part, each of said contact pins having a first end portion which electrically contacts the terminal of the electrical part, a second end portion which electrically contacts the printed circuit board, and an elastic portion between the first and second end portions so as to be flexed in one direction and, before mounting of the socket body to the printed circuit board, the first and second end portions being positioned projecting upward and downward, respectively, through a first through hole formed to the upper plate and a second through hole formed to the base portion, and being bent and inclined in a same direction as the flexed direction with respect to a perpendicular direction, and an upper and a lower edge, respectively, of the first and second end portions being offset in a horizontal direction with respect to a center line of the first and second through holes, and after the mounting of the socket body to the printed circuit board and accommodating of the electrical part to the socket, the upper edge of the first end portion is positioned at approximately the same height as the height of an upper end of the first through hole, and the lower edge of the second end portion is positioned at approximately the same height as the height of a lower end of the second through hole, and the first and second end portions, respectively, are oriented in a perpendicular direction along the first and second through holes.

* * * * *